US009205007B2

(12) United States Patent
Chinn

(10) Patent No.: US 9,205,007 B2
(45) Date of Patent: Dec. 8, 2015

(54) LIFE SUPPORT LITTER HAVING A PLURALITY OF VIBRATION DAMPERS

(75) Inventor: Robert Chinn, Wilmington, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 277 days.

(21) Appl. No.: 13/884,385

(22) PCT Filed: Nov. 10, 2011

(86) PCT No.: PCT/US2011/060162

§ 371 (c)(1),
(2), (4) Date: Jun. 19, 2013

(87) PCT Pub. No.: WO2012/064942

PCT Pub. Date: May 18, 2012

(65) Prior Publication Data

US 2013/0340170 A1 Dec. 26, 2013

Related U.S. Application Data

(60) Provisional application No. 61/412,053, filed on Nov. 10, 2010.

(51) Int. Cl.
*A61G 1/04* (2006.01)
*A61G 1/048* (2006.01)

(52) U.S. Cl.
CPC *A61G 1/04* (2013.01); *A61G 1/048* (2013.01); *A61G 2001/042* (2013.01)

(58) Field of Classification Search
CPC ..... A61G 3/006; A61G 2005/1078; A61G 2005/1081; A61G 7/015; A61G 1/00; A61G 1/044; A61G 1/048; A61G 1/052; A61G 1/06; A61G 1/04; A61G 2001/042
USPC ..... 5/625, 627, 628, 110, 111, 112
See application file for complete search history.

(56) References Cited

U.S. PATENT DOCUMENTS 1,924,496 A 8/1933 Herod
2,924,831 A * 2/1960 Hankins ..... 5/626

(Continued)

FOREIGN PATENT DOCUMENTS

DE 331872 C 1/1921
DE 340716 C 6/1921

(Continued)

OTHER PUBLICATIONS

D. D. L. Chung, Review Materials for vibration damping, 2001, Kluwer Academinc Publishers, Journal of Materials Science, 36ed, pp. 5733-5737.*

(Continued)

*Primary Examiner* — Robert G Santos
*Assistant Examiner* — Ifeolu Adeboyejo
(74) *Attorney, Agent, or Firm* — Dinsmore & Shohl LLP

(57) ABSTRACT

Life support litters (10) include a bed assembly (20) including a mattress (26) connected to a mattress frame (25), a chassis assembly (30) connected to and supporting the mattress frame, the chassis assembly operable to secure the life support litter to a transport vehicle, and a plurality of vibration dampeners (40, 41, 42, 43, 44, 50, 54, 60, 61, 39, 26), disposed about the life support litter and operable to reduce vibrations of a plurality of frequencies, wherein the plurality of vibration dampeners comprises a first vibration dampener operable to reduce vibrations of a first frequency range from a first vibration source and a second vibration dampener operable to reduce vibrations of a second frequency range from a second vibration source and wherein the first frequency range is different than the second frequency range.

17 Claims, 9 Drawing Sheets

(56) References Cited

U.S. PATENT DOCUMENTS

| | | | | | |
|---|---|---|---|---|---|
| 3,211,495 | A | * | 10/1965 | Nielsen | 297/68 |
| 3,456,269 | A | * | 7/1969 | Goodman | 5/618 |
| 4,037,871 | A | * | 7/1977 | Bourgraf et al. | 296/20 |
| 4,767,148 | A | * | 8/1988 | Ferneau et al. | 296/20 |
| 4,947,418 | A | * | 8/1990 | Barr et al. | 378/177 |
| 5,435,027 | A | * | 7/1995 | Bourgraf et al. | 5/611 |
| 5,537,700 | A | * | 7/1996 | Way et al. | 5/611 |
| 5,860,176 | A | * | 1/1999 | Norberg | 5/628 |
| 5,996,149 | A | * | 12/1999 | Heimbrock et al. | 5/601 |
| 6,175,977 | B1 | * | 1/2001 | Schumacher et al. | 5/626 |
| 2004/0055088 | A1 | * | 3/2004 | Heimbrock et al. | 5/618 |
| 2007/0089236 | A1 | | 4/2007 | Bailey-VanKuren et al. | |
| 2011/0099717 | A1 | * | 5/2011 | Windauer | 5/627 |

FOREIGN PATENT DOCUMENTS

| | | | |
|---|---|---|---|
| DE | 499357 | C | 6/1930 |
| DE | 19546822 | A1 | 6/1997 |
| FR | 2724315 | A1 | 3/1996 |
| GB | 727404 | | 3/1955 |
| GB | 1 388 960 | | 4/1975 |
| GB | 2 408 691 | A | 6/2005 |
| JP | SHO 62-66858 | | 3/1987 |
| JP | HEI 05-000132 | | 1/1993 |
| JP | 2000-140026 | | 5/2000 |
| JP | 2003-10250 | | 1/2003 |
| JP | 2005-137564 | A | 6/2005 |
| JP | 2010-500122 | | 1/2010 |
| WO | 2008/021731 | A1 | 2/2008 |

OTHER PUBLICATIONS

Onda, Acoustic Properties, Apr. 11, 2003, Onda Corparation.*

Alan R. Selfidge, IEEE Transactions on Sonic and Ultrasonics, May 1985, vol. SU-32, No. 3, pp. 381-394.*

Australian Examination Report, dated Apr. 24, 2014 pertaining to Australian Patent Application No. 2011326486.

Invitation to Pay Additional Fees with Partial International Search Results dated Apr. 4, 2012 pertaining to International application No. PCT/US2011/060162.

International Search Report and Written Opinion dated Jul. 20, 2012 pertaining to International application No. PCT/US2011/060162.

International Preliminary Report on Patentability dated May 14, 2013 pertaining to International application No. PCT/US2011/060162.

New Zealand Examination Report, dated Jun. 13, 2014 pertaining to New Zealand Patent Application No. 610727.

Office Action dated Apr. 16, 2015 pertaining to Japanese Patent Application No. 2013-538881.

* cited by examiner

LIFE SUPPORT LITTER HAVING A PLURALITY OF VIBRATION DAMPERS

Life support litters can be used to secure and transport patients from a point of physical trauma to a facility for treatment. Such transport can involve multiple transport vehicles (e.g., people, automobiles, planes, helicopters, etc.), each of which may impart various forces onto the life support litter. For example, a life support litter traveling in an ambulance may experience constant vibrations in a first frequency range. Then, when the life support litter is placed in a helicopter, it may experience constant vibrations in a second frequency range completely or partially distinct from the first frequency range. These vibrations of various frequency ranges from multiple different external sources may impair the comfort or even health of the patient secured to the mattress. Moreover, due to the different physical constraints for each of the transport vehicles, life support litters are often restricted in their dimensions and features. These limitations may further prevent a patient's improvement without, for example, the flexibility to adjust their position. Alternatively or additionally, these limitations may prevent the storage of medical equipment in a readily accessible location near the patient.

Accordingly, a need exists for alternative life support litters for reduced vibrations and enhanced patient care.

In one embodiment, a life support litter includes a bed assembly including a mattress connected to a mattress frame, a chassis assembly connected to and supporting the mattress frame, the chassis assembly operable to secure the life support litter to a transport vehicle, and a plurality of vibration dampeners disposed about the life support litter and which may be operable to reduce vibrations of a plurality of frequencies. The plurality of vibration dampeners include a first vibration dampener that may be operable to reduce vibrations of a first frequency range from a first vibration source and a second vibration dampener that may be operable to reduce vibrations of a second frequency range from a second vibration source, wherein the first frequency range may be different than the second frequency range.

In another embodiment, a life support litter includes a bed assembly including a mattress connected to a mattress frame, a chassis assembly connected to and supporting the mattress frame. The chassis assembly may include a first upper horizontal tube connected to a first lower horizontal tube by a first plurality of vertical chassis supports and a second upper horizontal tube connected to a second lower horizontal tube by a second plurality of vertical chassis supports, wherein the first upper and lower horizontal tubes are connected to the second upper and lower horizontal tubes by a plurality of crossbars. The life support litter may further include a plurality of vibration dampeners disposed at a plurality of mattress frame connections between the chassis assembly and the mattress frame. The plurality of vibration dampeners may be operable to reduce vibrations of a plurality of frequencies.

These and additional features provided by the embodiments described herein will be more fully understood in view of the following detailed description, in conjunction with the drawings.

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

Figure 1:
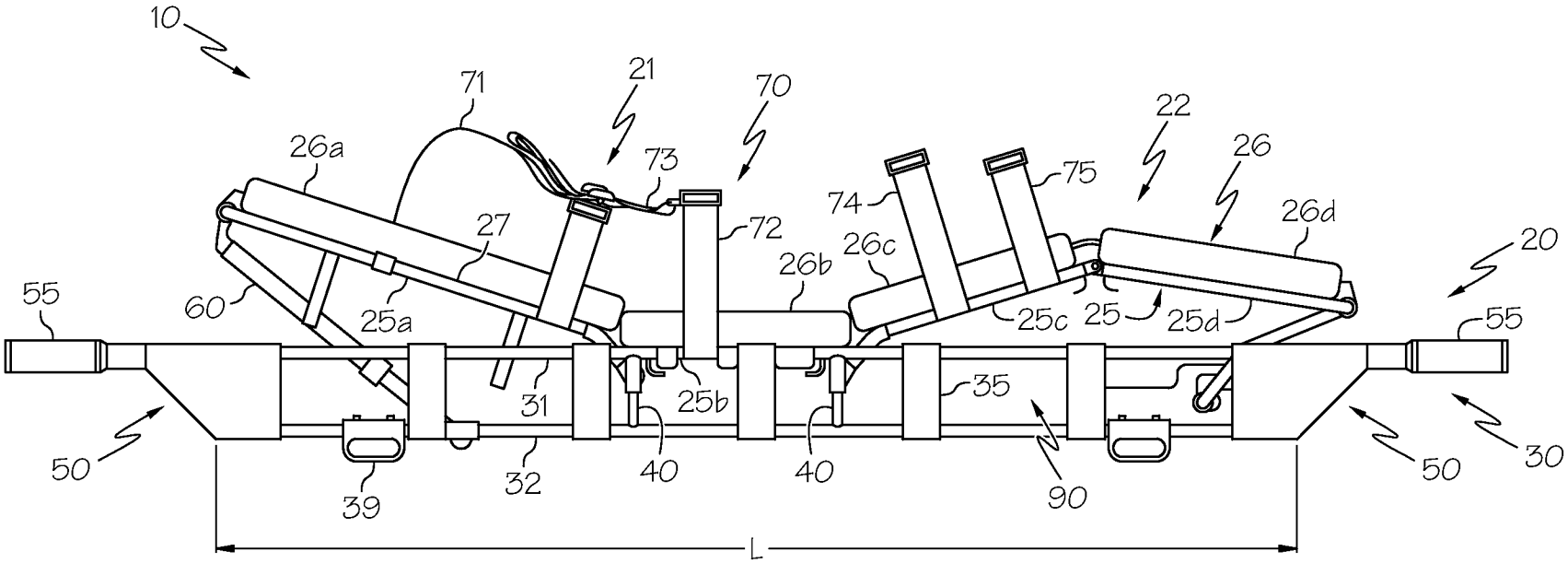
FIG. 1 is a side view depicting a life support assembly according to one or more embodiments shown and described herein.

FIG. 1 generally depicts one embodiment of a life support litter. The life support litter generally comprises a bed assembly supported by a chassis assembly. The life support litter further comprises a plurality of vibration dampeners disposed about the life support litter to help isolate a patient placed on the mattress from vibrations from external sources. Different vibration dampeners may be tuned to different vibration frequencies to maximize the range of vibration frequencies dampened before being felt by a patient. The life support litter can further comprise various other features enhancing patient safety and comfort such as an adjustable mattress frame and/or a storage area within the chassis assembly provided with universal mounting brackets. Various embodiments of the life support litter will be described in more detail herein.

Figure 2:
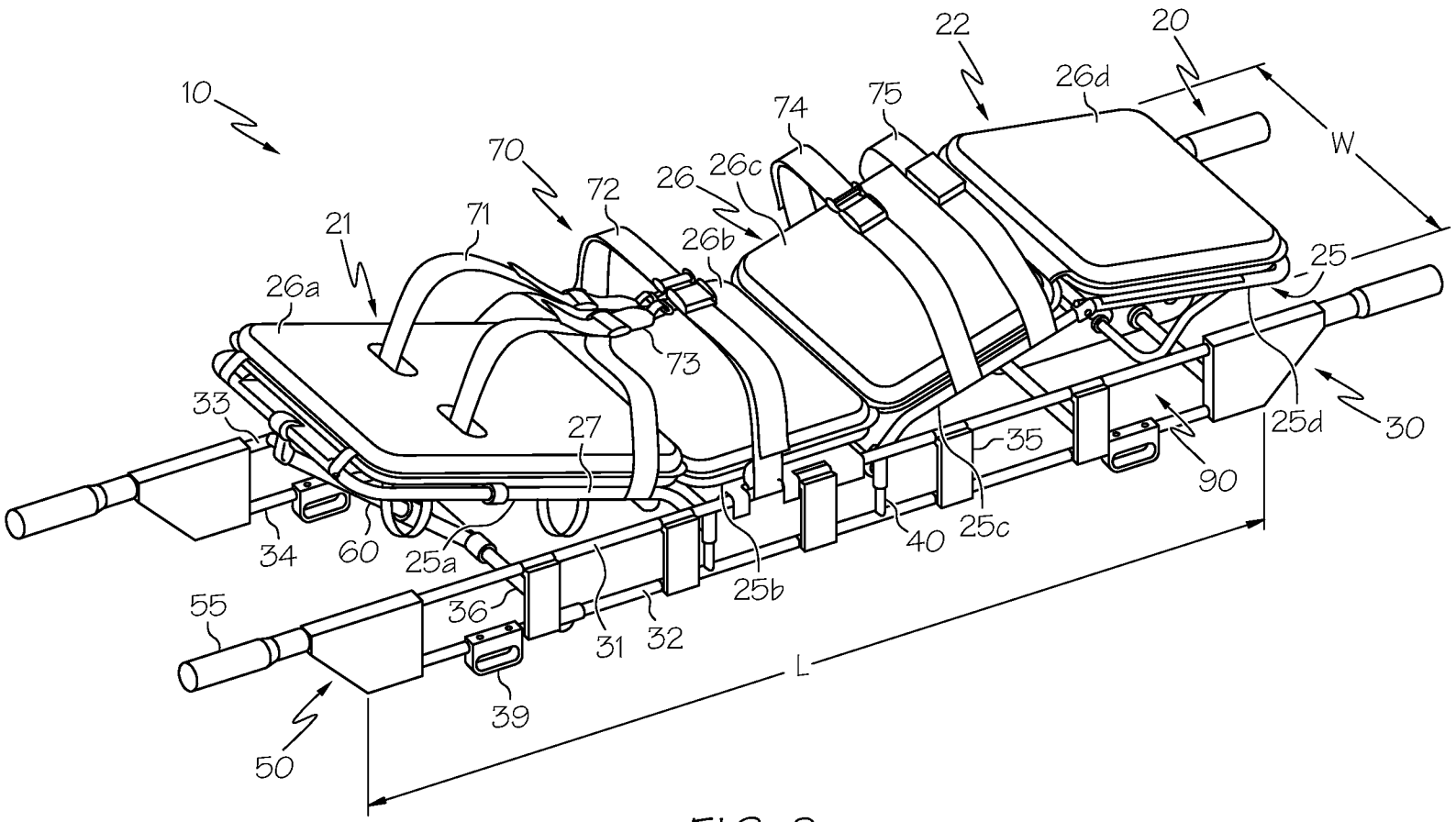
FIG. 2 is a top perspective view depicting a life support assembly according to one or more embodiments shown and described herein.

Referring now to FIGS. 1 and 2, one embodiment of a life support litter 10 is depicted. The life support liter 10 may generally comprise a bed assembly 20 connected to and supported by a chassis assembly 30. In one embodiment, the bed assembly 20 may comprise a mattress 26 supported by a mattress frame 25. The mattress 26 may comprise any material such as foam, rubber, cloth or other padding, either alone or in combination, in which an individual may be disposed thereon. For example, in one embodiment, the mattress 26 may comprise an air mattress wherein the mattress 26 comprises one or more air bladders that can individually support various sections of an individual disposed thereon. In another embodiment, the mattress 26 may comprise a plurality of sections 26*a*, 26*b*, 26*c* and 26*d* such that the position of each of the plurality of sections 26*a*, 26*b*, 26*c* and 26*d* may be individually adjusted relative to one another (as may occur when the mattress frame 25 also comprises a plurality of sections 25*a*, 25*b*, 25*c* and 25*d* as will become appreciated herein). The mattress 26 may be fastened to the mattress frame 25 using clips, belts, Velcro, or any other operable connection. In yet another embodiment, one or more harnesses used to secure a patient to the mattress 26 may also serve to secure the mattress 26 to the mattress frame 25 as will become appreciated later herein.

Figure 3:
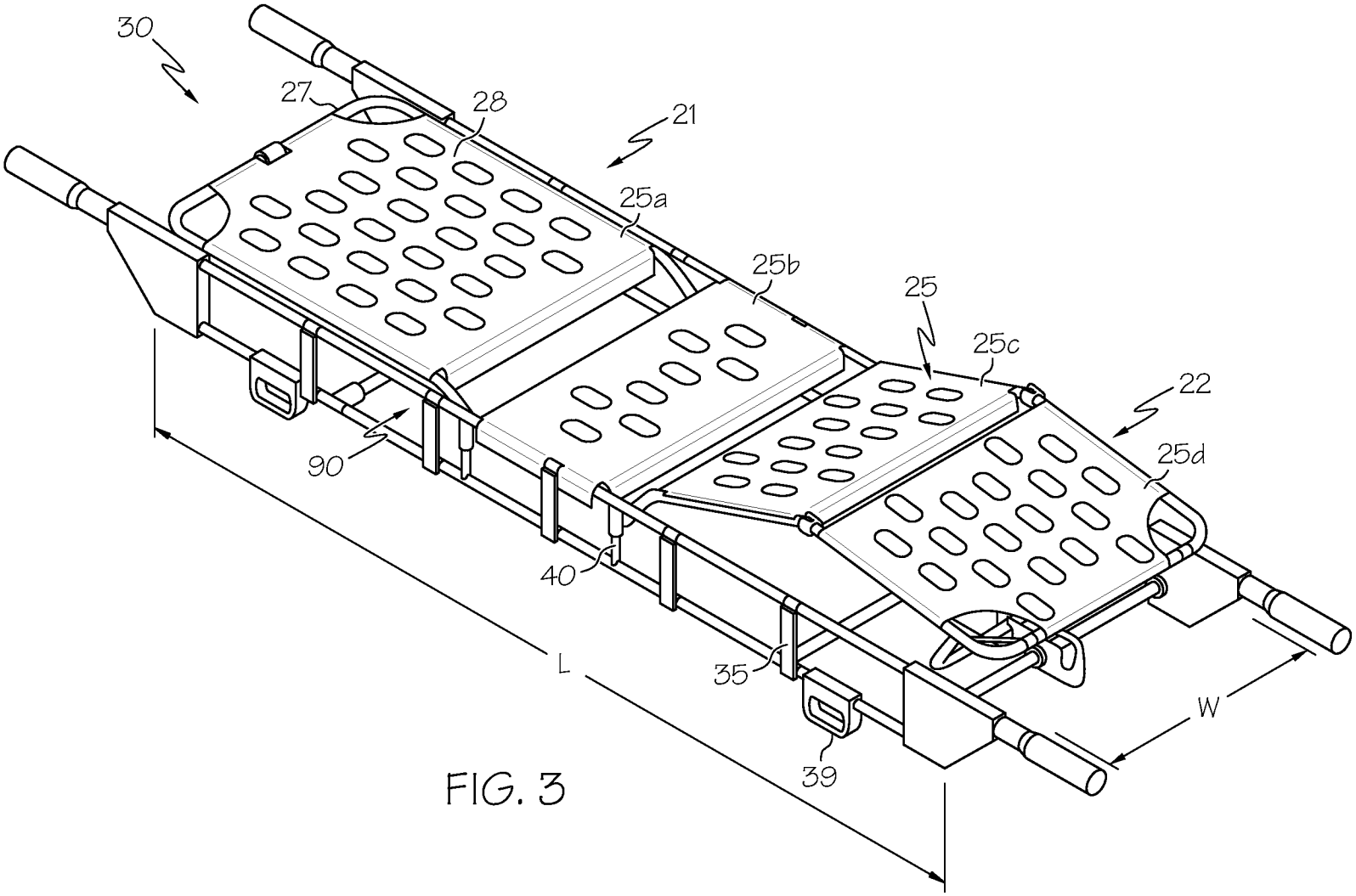
FIG. 3 is a top perspective view depicting a mattress frame connected to and supported by a chassis assembly according to one or more embodiments shown and described herein.

The mattress frame 25 can comprise any structure operable to support the mattress 26 as well as connect to the chassis assembly 30. For example, the mattress frame 25 can comprise a plurality of flat surface sections 25*a*, 25*b*, 25*c* and 25*d* that are either continuously solid or contain one or more gaps. In one specific embodiment, as best illustrated in FIG. 3, the mattress frame 25 may comprise an outer tube 27 that extends around the outer periphery of the mattress frame 25. A supporting material 28 may be secured to the outer tube 27 such that it is disposed within the central region of the outer tube 27 (as illustrated) to comprise each of the plurality of flat surface sections 25*a*, 25*b*, 25*c* and 25*d*. The supporting material 28 can comprise any plastic, mesh, wood or other material sufficient to support both a mattress and a patient. In yet another embodiment, the mattress frame 25 may be integral with the mattress 26 such that the mattress 26 and mattress frame 25 are permanently connected. For example, a mattress 26 may comprise an internal mattress frame 25 operable to connect to the chassis assembly 30 such that the mattress frame 25 is integral with the mattress 26. The mattress 26 and the mattress frame 25 may comprise any length L and width W operable to have a mattress 26 supported on the mattress frame 25 and support a patient disposed thereon. For example, in one embodiment, the mattress 26 and mattress frame 25 may comprise dimensions substantially uniform with its intended application (e.g., civilian use, military use, aircraft, ground vehicle, etc.) such that the dimensions of the mattress 26 disposed on the mattress frame 25 do not interfere with its immediate surroundings. In one embodiment, a variety of mattresses 26 and/or a variety of mattress frames 25 may be available for modular use such that an individual mattress 26 may be selected for an individual mattress frame 25 based on their particular physical properties.

Referring to FIGS. 1-4, the bed assembly 20 may comprise an upper body section 21 and a lower body section 22. The upper body section 21 may be the portion of the bed assembly 20 that supports the upper body of a patient (i.e., the portion of the body above the waist). The lower body section 22 may be the portion of the bed assembly 20 that supports the lower body of the patient (i.e., the legs of the patient). In one exemplary embodiment, such as that illustrated in FIGS. 1-4, the upper body section 21 and/or the lower body section 22 may be adjustable. As used herein, "adjustable" means operable to raise or lower the patient's upper body and/or lower body relative to the rest of their body when disposed on the bed assembly 20. For example, as best illustrated in FIGS. 1-2, the adjustable upper body section 21 may be raised via a moveable strut 60 such that a patient's head would be elevated higher than his chest. Furthermore, the adjustable lower body section 22 may also be raised such that the patient's feet would be elevated relative their torso. It should be appreciated that the adjustable upper body section 21 and the adjustable lower body section 22 may further be adjustable in any alternative configuration to change the positioning of the patient.

Figure 4:
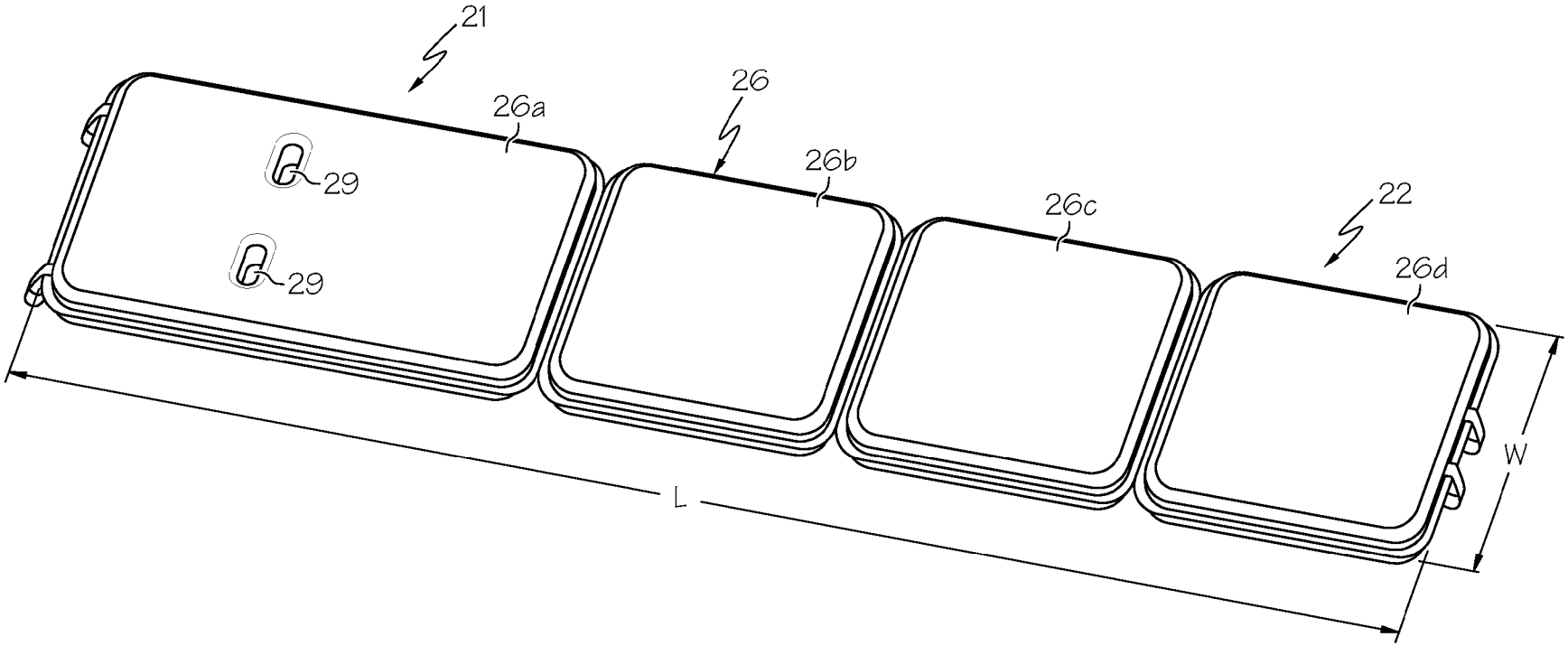
FIG. 4 is a top perspective view depicting a mattress according to one or more embodiments shown and described herein.

Referring to FIGS. 1, 2 and 4, the bed assembly 20 may further comprise one or more safety restraints 70 to releasably restrain a patient to the mattress 26. The safety restraints 70 may comprise any combination of various harnesses and belts that can wrap around a patient lying on the mattress 26 and adjustably tighten to restrict the patient's movement away from the bed assembly 20. In one embodiment, the bed assembly 20 may comprise an upper torso harness 71 operable to secure the upper torso of a patient. For example, as best illustrated in FIG. 2, the upper torso harness 71 may comprise both shoulder straps and a chest strap. The upper body section 21 of the bed assembly 20 may comprise slits to receive the shoulder straps of the upper torso harness 71 such that a patient's head and neck may be disposed between the two shoulder straps. The upper torso harness 71 may further connect to a mid-section belt 72 via one or more clips 73, which restricts a patient from sliding head-first off of the bed assembly 20 due to sudden movement (such as rapid acceleration or deceleration). In another embodiment, as shown in FIGS. 1 and 2, the safety restraints 70 may further comprise one or more leg belts 74, 75. The leg belts 74, 75 may be operable to secure a patient's legs to the bed assembly 20 by passing over and securing to the patient's body. The leg belts 74, 75 as well as the rest of the safety restraints 70, may comprise any type of safety restraint operable to secure the patient. In one embodiment, the first leg belt 74 may comprise a belt that is operable to withstand excessive force (such as those used in aviation applications) potentially caused by transportation accidents. The second leg belt 75 may comprise a more comfortable leg belt that can secure the patient's leg with improved comfort but cannot resist the same amount of force as a sturdier belt. Furthermore, the safety restraints may be fixed to or removable from the bed assembly 20. For example, fixed belts may be sewn into the mattress 26, secured to the mattress frame 25 or otherwise connected to the bed assembly 20. Removable belts may simply wrap around the mattress 26, or the entire bed assembly 20, and only become secured to the mattress 26 (and the patient) when clipped. It should be appreciated that any other configuration of safety restraints 70 may further be implemented onto, or in connection with, the bed assembly 20 such that a patient can become releasably secured to the bed assembly 20.

As mentioned above, the bed assembly 20 connects to and is supported by the chassis assembly 30 of the life support litter 10. Referring now to FIGS. 1-3, the chassis assembly 30 may comprise any structure or framework that is operable to connect and support the bed assembly 20 as well as allow for securement with a transport vehicle (e.g., an ambulance, helicopter, airplane, truck, etc.). In one embodiment, such as that illustrated in FIGS. 1-3, the chassis assembly 30 can comprise a first upper horizontal tube 31 connected to a first lower horizontal tube 32 by a first plurality of vertical chassis supports 40 and further comprise a second upper horizontal tube 33 connected to a second lower horizontal tube 34 connected by a second plurality of vertical chassis supports (not shown). The first set of tubes (i.e., the first upper horizontal tube 31 and the first lower horizontal tube 32) can be connected to the second set of tubes (i.e., the second upper horizontal tube 33 and the second lower horizontal tube 34) by a plurality of crossbars 36. In one embodiment, the first set of tubes and the second set of tubes may all share a common length L. The common length L can comprise any length L operable to connect and support the bed assembly 20 such as the length of the bed assembly 20 or a length shorter than or longer than the bed assembly 20. In another embodiment, the first upper horizontal tube 31 and the second upper horizontal tube 33 may comprise a length L different than that of the first lower horizontal tube 32 and the second lower horizontal tube 34. It should be appreciated that the lengths L of the individual upper and lower horizontal tubes 31, 32, 33 and 34 may comprise any length operable to connect and support a bed assembly 20.

The plurality of crossbars 36 may separate the first set of tubes 31, 32 from the second set of tubes 33, 34 by a distance substantially similar to the width of the bed assembly 20. In one exemplary embodiment, the plurality of crossbars 36 may have a width W wider than the bed assembly 20 such that the entire bed assembly 20 is disposed between the first set of tubes 31, 32 and the second set of tubes 33, 34. In another embodiment, the plurality of crossbars 36 may have a width W narrower than the width W of the bed assembly 20 such that a portion of the bed assembly 20 hangs over the first set of tubes 31, 32 and or the second set of tubes 33, 34. In yet another embodiment, the plurality of crossbars 36 may be adjustable to accommodate bed assemblies 20 of various frames. For example, in such an embodiment, the plurality of crossbars 36 may comprise telescoping members that can extend and retract in the width direction W. Furthermore, the chassis assembly 30 may comprise any number of the plurality of crossbars 36 such as for example, one, three or five. The plurality of crossbars 36 may be distributed about the chassis assembly either symmetrically or asymmetrically, such that the plurality of crossbars 36 can either be evenly distributed or selectively distributed about the bed assembly 20.

As discussed above, in one exemplary embodiment, the chassis assembly 30 of the life support litter 10 may comprise one or more vertical chassis supports 40. The vertical chassis supports may comprise any brace, truss or the like connecting two or more components of the chassis assembly 30. For example, in one embodiment (as illustrated in FIGS. 1-3), the vertical chassis supports 40 may connect the first upper horizontal tube 31 to the first lower horizontal tube 32. In another embodiment, the vertical chassis supports 40 may connect the second upper horizontal tube 33 to the second lower horizontal tube 34. In yet another embodiment, the vertical chassis supports 40 may connect other components of the chassis assembly 30 including the first upper horizontal tube 31, the first lower horizontal tube 32, the second upper horizontal tube 33 and the second lower horizontal tube 34. The vertical chassis supports 40 may comprise the same material as the chassis assembly 30, a different material as the chassis assembly 30, or combinations thereof. Furthermore, the vertical chassis supports 40 may be integral with the chassis assembly 30 such that the chassis assembly 30 and the vertical chassis supports 40 comprise essentially one piece, or alternatively, the vertical chassis supports 40 may comprise a separate piece that is connected to the chassis assembly 30 via clamps, bolts, screws, pins or the like. The chassis assembly 30 can comprise any number of vertical chassis supports 40 and the vertical chassis supports 40 can be disposed in any configuration about the chassis assembly. For example, in one embodiment, such as that illustrated in FIGS. 1 and 2, the chassis assembly 30 can comprise two vertical chassis supports 40 on each side of the chassis assembly 30 for a total of four vertical chassis supports on the overall chassis assembly. Specifically, two vertical chassis supports 40 can connect the first upper horizontal tube 31 and the first lower horizontal tube 32 while two additional vertical chassis supports 40 connect the second upper horizontal tube 33 to the second lower horizontal tube 34. In such an embodiment, the vertical chassis supports 40 may prevent the bending of the first upper horizontal tube 31 and the second upper horizontal tube 33 when a patient is disposed on the mattress 26 of the bed assembly 20.

In one specific embodiment, as shown in FIG. 1, the one or more vertical chassis supports 40 connecting the first upper horizontal tube 31 to the first lower horizontal tube 32 and/or the second upper horizontal tube 33 to the second lower horizontal tube 34 can all comprise a common height. This may allow for the first upper horizontal tube 31 to be separated from the first lower horizontal tube 32 and the second upper horizontal tube 33 separated from the second lower horizontal tube 34 by a common height. The chassis assembly 30 can thereby comprise a storage area 90 directly beneath the bed assembly 20 which may be used for storing various medial equipment (i.e. other tools or supplies that may assist in the caring of a patient disposed on the life support litter 10). Such medical equipment can comprise, for example, gas tanks, patient monitors and/or medical pumps.

In one particular embodiment, the life support litter 10 may comprise a standardized mounting track 35. The standardized mounting track 35 may connect the first upper horizontal tube 31 to the first lower horizontal tube 32 and/or the second upper horizontal tube 33 with the second lower horizontal tube 34 as well being operable to support a variety of medical equipment containing standardized complementary mounting pins. For example, the standardized mounting track 35 may comprise any track or mounting surface operable to receive standardized mounting pins that are complementary to the standardized mounting track 35. The mounting pins may be secured to a variety of different medical equipment such that various individual pieces may be substituted in and out along the standardized mounting track 35. The complementary mounting pieces may thereby be connected to various medical equipment such that various medical equipment can be interchangeably stored in the storage area 90 of the chassis assembly 30.

As mentioned above, the bed assembly 20 can connect to the chassis assembly 30. In one embodiment, the mattress frame 25 of the bed assembly 20 may connect to the chassis assembly 30 via one or more mattress frame connections. Additionally, any type of mattress frame connection between the bed assembly 20 and the chassis assembly 30 may be implemented to ultimately secure the mattress 26 of the bed assembly 20 relative to the chassis assembly 30. For example, as illustrated in FIG. 2, in one embodiment, one or more locations of the outer tube 27 of the mattress frame 25 may connect to one or more components of the chassis assembly (e.g., the first upper horizontal tube 31, the first lower horizontal tube 32, the second upper horizontal tube 33, the second lower horizontal tube 34 or one of the plurality of crossbars 36) either directly or indirectly. The connections can be facilitated by brackets, screws, bolts, clamps, clips or any other similar device operable to fixedly secure the mattress frame 25 to the chassis assembly 30. In one specific embodiment, one or more moveable struts 60 may interconnect part of the mattress frame 25 to part of the chassis assembly 30 such as by connecting the outer tube 27 of the mattress frame 25 to one of the plurality of crossbars 36 of the chassis assembly 30. In another specific embodiment, one or more of the plurality of safety restraints may connect to the chassis assembly 30 (such as the mid-section belt 72) such that the safety restraint further secures the bed assembly 20 to the chassis assembly 30 when in use.

Figure 6:
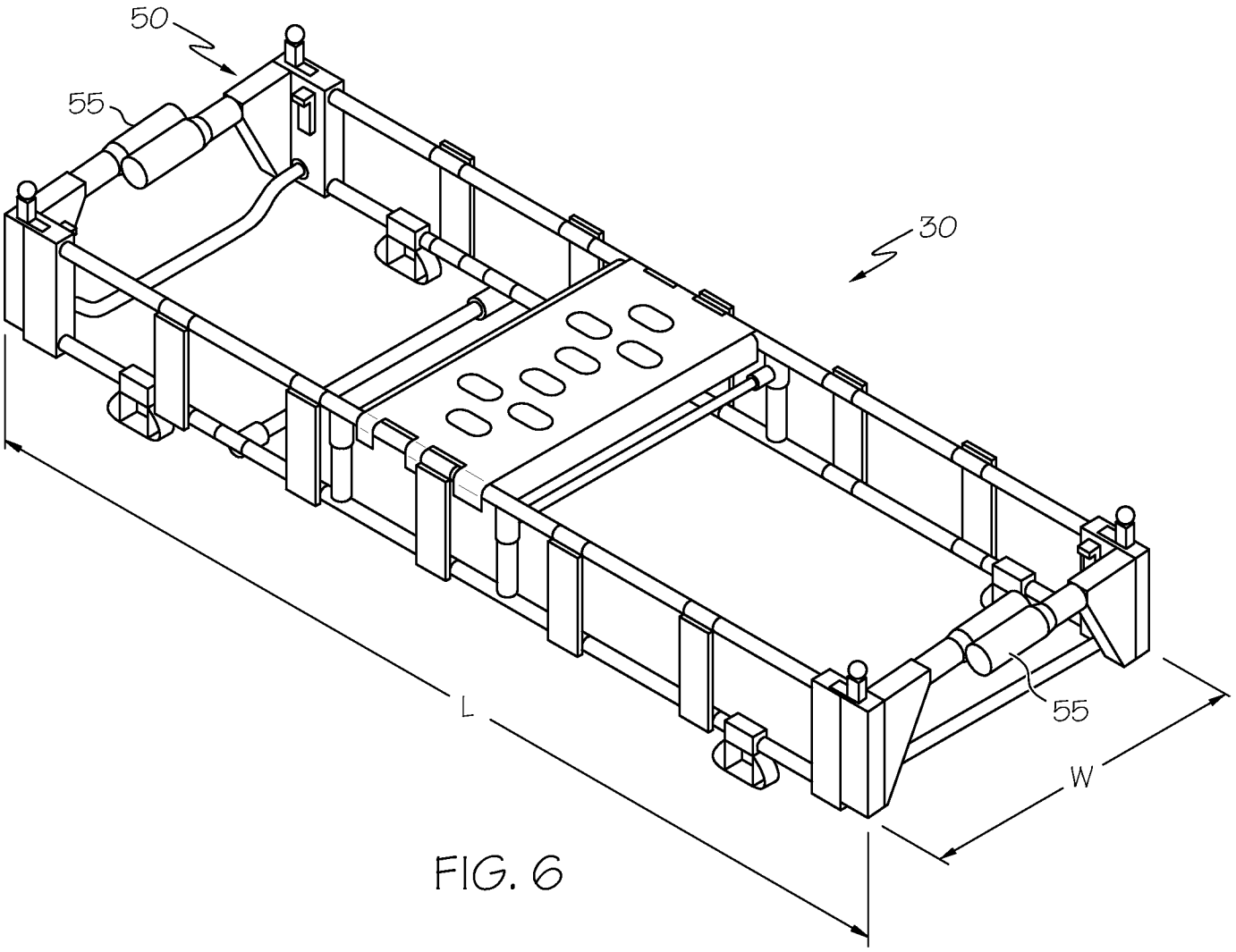
FIG. 6 is a top perspective view depicting a chassis assembly according to one or more embodiments shown and described herein.

In one embodiment, the life support litter 10 may comprise a plurality of grips 55. The plurality of grips 55 may comprise any extension of the life support litter 10 that enables the lifting or transportation of the life support litter 10. As best illustrated in FIG. 2, one exemplary life support litter 10 may comprise four grips 55 positioned at each of the four corners of the chassis assembly 30. The grips 55 may allow for one person on each side of the life support litter 10 to lift and transport the life support litter 10 to a new location. Referring now to FIGS. 1-3 and 6, in one exemplary embodiment, the life support litter may comprise a plurality of grip assemblies 50 that are each collapsible. For example, the grip assemblies 50 may transition between an extended position (as illustrated in FIGS. 1-3) and a collapsed position (as illustrated in FIG. 6). While in the collapsed position, the plurality of grip assemblies 50 may fold, retract or otherwise collapse in towards the chassis assembly 30 such that the overall length L of the chassis assembly 30 is decreased. The grip assemblies 50 may thereby allow the chassis assembly 30 and the overall life support litter 10 to be stored in more confined spaces. The grip assemblies 50 may be collapsible by any operable mechanism. For example, in one embodiment, each of the plurality of grip assemblies 50 may be connected to the chassis assembly 30 along a hinge that can rotate the grips between the extended and collapsed position. In such an embodiment, a removable pin or the like may be operable to lock grips into position.

Referring now to FIGS. 1-3, the life support litter 10 may further comprise a plurality of feet 39 to raise the life support litter 10 from the ground when disposed thereon. For example, in one embodiment, the plurality of feet 39 may be lower legs or protrusions disposed about the first lower horizontal tube 32 and the second lower horizontal tube 34 of the chassis assembly 30. In such an embodiment, the plurality of feet 39 may comprise extensions that would make direct contact with the ground so that the first lower horizontal tube 32, the second lower horizontal tube 34 and the rest of the chassis assembly 30 remain elevated off of the ground. The plurality of feet 39 may thereby allow the life support litter 10 to be positioned on the ground without directly scraping or otherwise damaging one or more individual components of the chassis assembly 30. In one embodiment, the plurality of feet 39 may collapse or swivel such that they can transition between an extended position and a collapsed position (similar to the collapsible grips discussed above). In another embodiment, the plurality of feet 39 may further be operable to assist in the securing of the life support litter 10 to various vehicles for transportation. For example, the plurality of feet 39 may be secured to the chassis assembly 30 such that the plurality of feet can be connected or secured to a vehicle so that the life support litter 10 is held in place. In such an embodiment, the feet may be strapped, clamped, locked or otherwise fixed in place to provide releasable securement between the vehicle and the life support litter 10.

Figure 5:
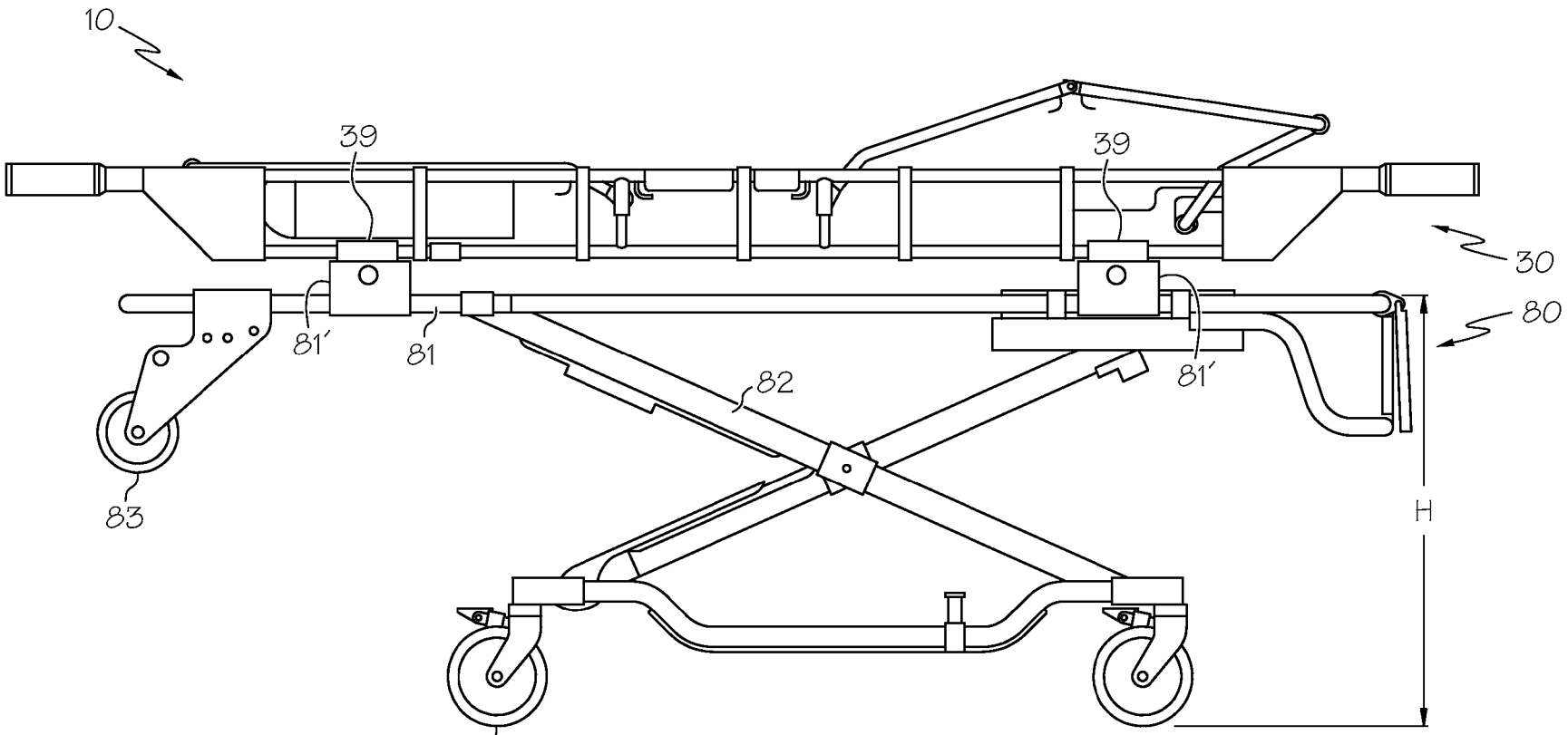
FIG. 5 is a side view depicting a life support assembly secured to a collapsible rolling cot according to one or more embodiments shown and described herein.

Referring now to FIG. 5, in another embodiment, the life support litter 10 may be releasably supported by a collapsible litter transport assembly 80. The collapsible litter transport assembly 80 may generally comprise a collapsible structure with wheels that allows for the assisted movement of the life support litter. Specifically, the collapsible litter transport assembly 80 can transition between an extended position to provide a greater height H (as illustrated in FIG. 5), and a collapsed position to provided a lower height H (such as required when disposed within an ambulance or similar vehicle. The collapsible litter transport assembly 80 may generally comprise a support frame 81 connected to collapsible legs 82. The support frame may comprise any structure operable to releasably secure the life support litter 10. For example, the support frame 81 of the collapsible litter transport assembly 80 may engage the feet 39, the first lower horizontal tube 32, the second lower horizontal tube 34 or any other part of the chassis assembly 30. The collapsible legs may comprise one or more legs operable to transition between an extended position (as illustrated in FIG. 5), wherein the height of the collapsible litter transport assembly 80 is increased, and a collapsed position, wherein the height of the collapsible litter transport assembly 80 is decreased. In one embodiment, such as that illustrated in FIG. 5, the collapsible legs 82 may comprise a scissor configuration wherein the collapsible legs 82 pivot around a central pin to extend and collapse. In another embodiment, the collapsible legs 82 may comprise telescoping legs that can internally retract to collapse. It should be appreciated that any other collapsible configuration may additionally or alternatively be used. Still referring to FIG. 5, the collapsible litter transport assembly 80 may further comprise a plurality of base wheels 84 at the base of the collapsible legs 82 to allow for the assisted movement of the collapsible litter transport assembly 80 over ground. In another embodiment, the collapsible litter transport assembly 80 may additionally comprise one or more front wheels 83 that may assist in the loading an unloading of the collapsible litter transport assembly 80 from a vehicle. The collapsible litter transport assembly 80 may connect to the chassis assembly 30 or any other part of the life support litter 10 through any releasable connection such as snaps, straps, buckles, clips or the like. In one specific embodiment, such as that illustrated in FIG. 5, the support frame 81 may comprise a plurality of securement grips 81' operable to releasably receive the plurality of feet 39 of the chassis assembly 30. The collapsible litter transport assembly 80 may comprise any other additional or alternative features that assist in the support and/or transportation of a life support litter 10 disposed thereon.

Referring now to FIGS. 1-4, the life support litter 10 may further comprise a plurality of vibration dampeners operable to reduce vibrations from external sources that may be felt by a patient disposed on the mattress. Vibrations from external sources may include, for example, vibrations caused by the movement of the transport vehicle in which the life support litter 10 is disposed (e.g., automobiles, planes, helicopters, etc.), vibrations incurred when transporting the life support litter on a collapsible litter transport assembly 80 as will become appreciated later herein, vibrations from heavy equipment in close proximity with the life support litter 10, or any other vibrations that can transfer through the life support litter 10 to a patient. Such vibrations may possess various or varying frequencies such that the life support litter 10 may be subjected to vibrations of multiple frequencies due to multiple sources or other dynamic conditions. For example, where the life support litter is transferred between a truck, ambulance, helicopter and/or aircraft as it is transported from the scene of an accident to a medical facility, each mode of transportation may impart a different frequency of vibration on the life support litter. Such frequency ranges of vibrations may comprise, for example, from about 1750 hertz (Hz) to about 1850 Hz, from about 450 Hz to about 550 Hz, and/or from about 30 Hz to about 70 Hz.

The plurality of vibration dampeners on or about the life support litter 10 can thus comprise multiple different vibration dampeners that are able to reduce vibrations of different frequency ranges. Specifically, a first vibration dampener (such as one or more of the vertical chassis supports 40) may be operable to reduce vibrations of a first frequency range (such as from about 1750 hz to about 1850 hz) from a first vibration source (such as a truck), a second vibration dampener (such as one or more of the grips 55) may be operable to reduce vibrations of a second frequency range (such as from about 450 hz to about 550 hz) from a second vibration source (such as a plane), and a third vibration dampener (such as one or more of the feet 39) may be operable to reduce vibrations of a third frequency range (such as from about 30 hz to about 70 hz) from a third vibration source (such as a helicopter). The vibration dampeners can comprise any or all of the above described elements of the life support litter 10 or may comprise additional elements to the life support litter wherein the elements are operable to reduce vibrations of a certain frequency range.

Referring now to FIGS. 1-3 and 7, in one embodiment, one of the plurality of vibration dampeners may comprise the one or more vertical chassis supports 40 (i.e., a brace, truss or similar structure connecting two or more components of the chassis assembly 30). For example, where the chassis support 40 comprises a rod, the rod may be surrounded by a rubber sleeve to absorb and dampen vibrations that would otherwise pass through the rod. Where the chassis support comprises a tube, the tube may comprise a rubber insert disposed internal the tube to absorb and dampen vibrations. In yet another embodiment, the chassis support 40 may itself solely consist of a rubber material. In even yet another embodiment, the connection joints 43, 44 between the chassis support 40 and its adjacent chassis assembly components (e.g., the first upper horizontal tube 31 and the first lower horizontal tube 32) may comprise one or more rubber elements such that the chassis support 40 and the adjacent chassis assembly components do not directly touch one another, but rather engage one another via rubber connections that dampen vibrations passed there between. For example, where the joint 43, 44 comprises a bolt, the joint 43, 44 may further comprise a rubber washer disposed between the chassis support 40 and the adjacent chassis component. Where the joint 43, 44 comprises a clasp that secures around the periphery of the chassis support 40, the clasp may be lined with rubber. Where the chassis support 40 is inserted into the adjacent chassis component, the chassis support 40 may comprise a rubber sleeve to separate the chassis support 40 from the adjacent chassis component. It should be appreciated that any other configuration may additionally or alternatively be realized to dampen vibrations that would otherwise pass through the chassis support 40.

As discussed above, the vertical chassis supports 40 may comprise a combination of horizontal supports 45 and vertical supports 41, 42 connected by joints 43, 44 to provide additional strength to the chassis assembly 30. In an embodiment where the chassis support 40 acts as a vibration dampener, the vertical supports 41, 42 may comprise a vibration dampening material such as rubber to reduce substantially vertical vibrations experienced by the chassis assembly 30 (and thus the life support litter 10). In another embodiment where the chassis support 40 comprises a vibration dampener, the horizontal support 45 may alternatively or additionally comprise a vibration dampening material to reduce substantially horizontal vibrations experienced by the chassis assembly 30 (and thus the life support litter 10). In yet another embodiment where the chassis support 40 comprises a vibration dampener, the joints 43, 44 (connecting the horizontal supports 45 and the vertical supports 41 to each other and to the chassis assembly 30) may comprise vibration dampening material to reduce vibrations from a variety of directions. In such embodiments, the chassis assembly 30 may comprise a single chassis support that comprises a vibration dampener, or a plurality of vibration supports that comprise vibration dampeners.

Referring now to FIGS. 1-3 and 8, in another embodiment, one of the plurality of vibration dampeners may comprise one or more grips 55 on the life support litter 10. For example, in one particular embodiment, one or more of the grip assemblies 50 may generally comprise a connection-end 51, a plug 52, a core 53, an insulator 54 and a grip 55. The connection-end 51 may comprise a structure integral with or attached to the chassis assembly 30 that physically connects the overall grip assembly 50 to the life support litter 10. The plug 52 may be insertable into the connection-end 51 and extend out there from such that the core 53 may slide over the plug 52 and provide the basis for an extended handle from the connection-end 51. The insulator 54 may slide over the core 53 to provide vibration dampening to the overall grip assembly 50 and the grip 55 may then connect to the core 53 and/or insulator 54. The insulator 54 may comprise any material that dampens vibrations and thereby prevents vibrations from traveling from the grip 55 to the connection-end 51 (and thus to the life support litter 10). For example, the insulator 54 may comprise rubber, foam, cloth, gel, or any other material operable to reduce vibrations. In another embodiment, one or more of the other components of the grip assembly 50 (e.g., the connection-end 51, the plug 52, the core 53 and the grip 55) may also comprise any material that dampens vibrations. In yet another embodiment, such as when the grip 55 is a single piece integral with the life support litter 10, the grip 55 may comprise a relatively rigid, vibration reducing material (such as a relatively stiff rubber) to both provide structural support for moving the life support litter 10 while also providing a vibration dampener.

In another embodiment, where the grip assembly 50 is collapsible between an extended position (as illustrated in FIGS. 1-3) and a collapsed position (as illustrated in FIG. 6), the grip assembly 50 may comprise a vibration dampener when in the collapsed position. For example, when the grip assembly 50 is in the collapsed position, vibrations that would have passed through the grip when in the extended position may no longer pass through to the bed assembly 20 due to the collapsed configuration. In addition, as the grip assembly 50 is disposed in the collapsed position, fewer external vibrations may engage the life support litter via the grips by limiting the possible contact locations between external vibrations sources and the life support litter.

Figure 7:
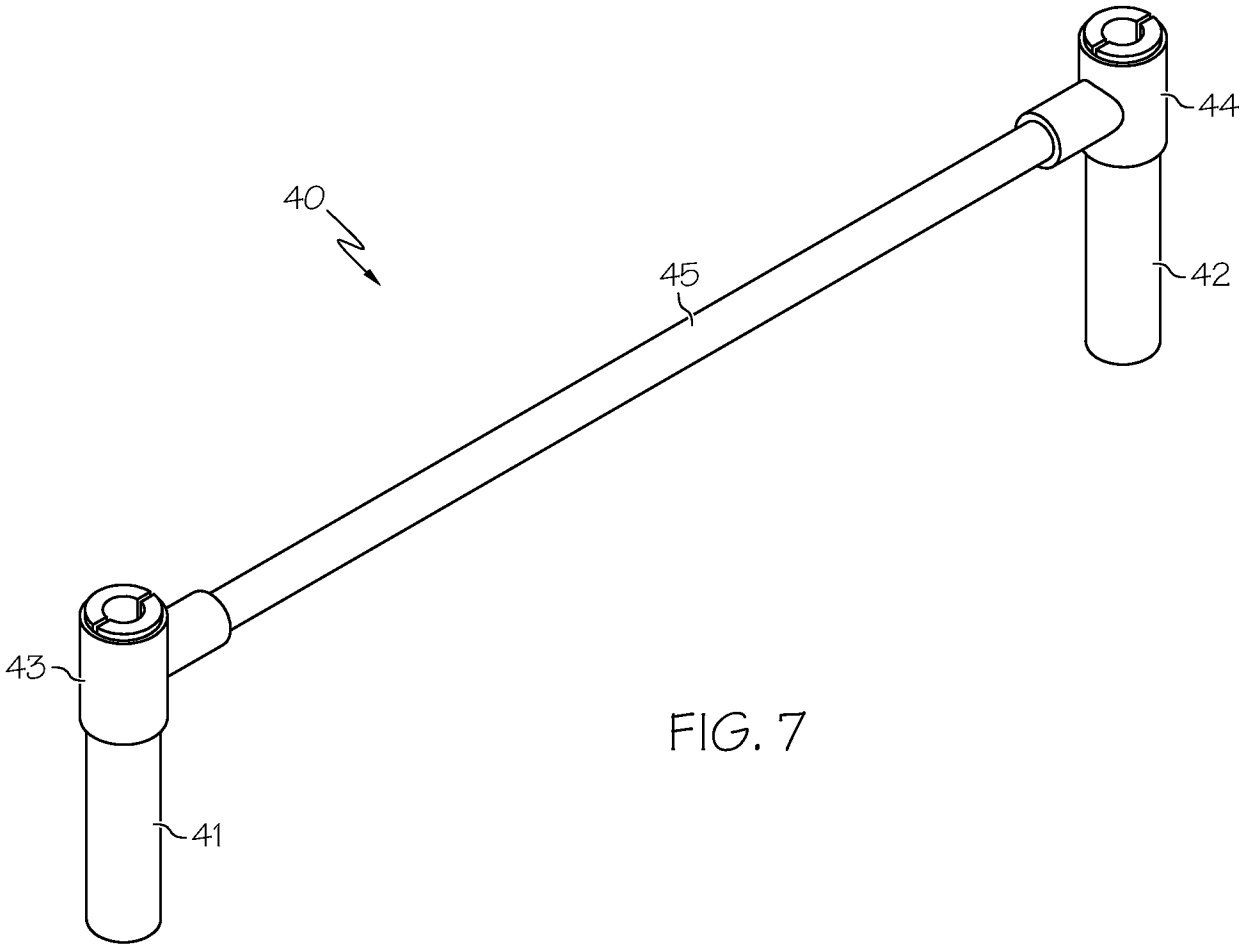
FIG. 7 depicts a vibration dampener comprising a chassis assembly support according to one or more embodiments shown and described herein.
Figure 8:
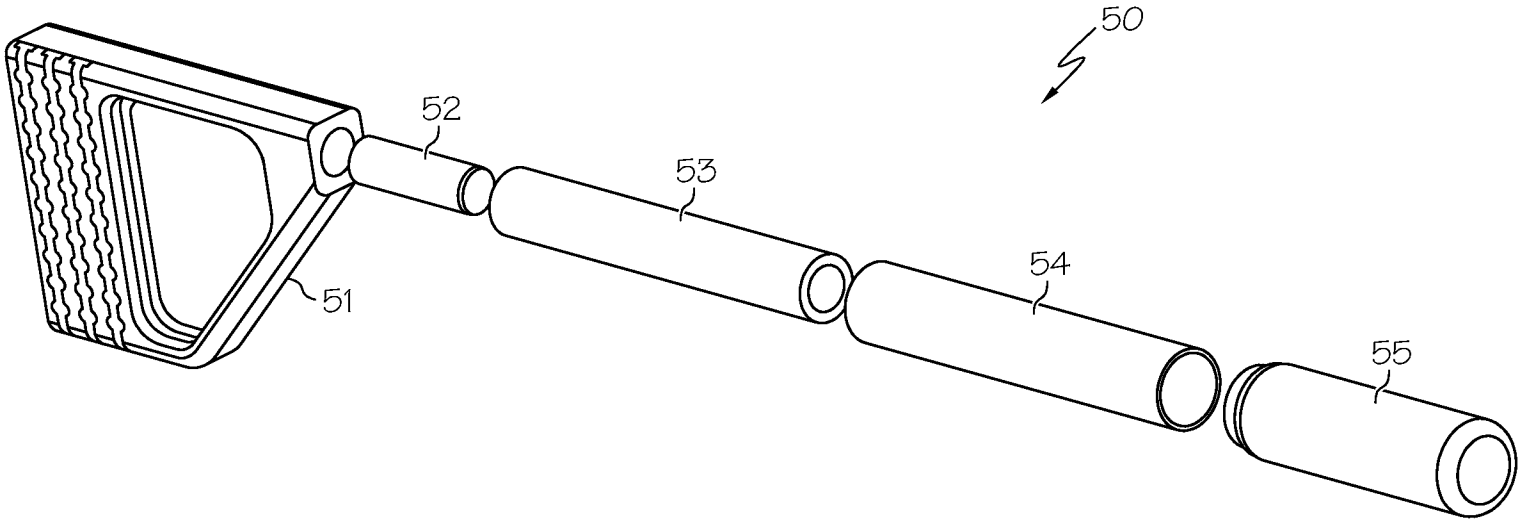
FIG. 8 is an exploded view of a vibration dampener comprising a grip assembly according to one or more embodiments shown and described herein.
Figure 9:
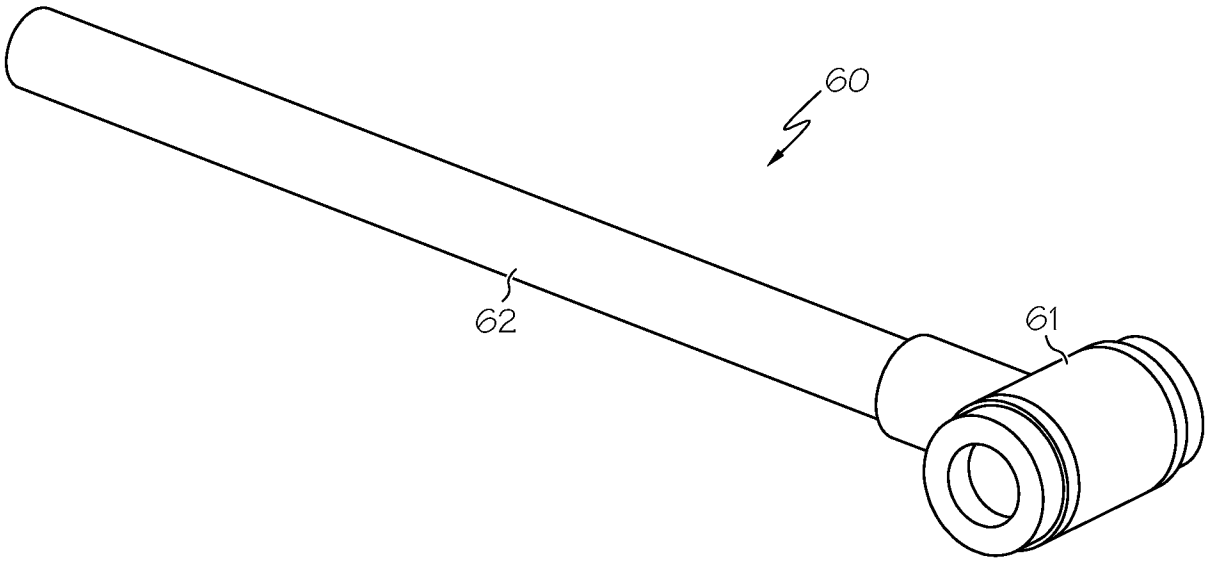
FIG. 9 depicts a vibration dampener comprising a rubber bushing for a moveable strut according to one or more embodiments shown and described herein.

Referring now to FIGS. 1-3 and 9, in yet another embodiment such as where the bed assembly 20 is adjustable via one or more moveable struts 60 connecting an adjustable upper body section 21 of the bed assembly 20 to one of the plurality of crossbars 36 of the chassis assembly 30, the plurality of vibration dampeners may be disposed where the moveable strut 60 connects to the adjustable upper body section 21 and where the moveable strut connects to the one of the plurality of crossbars 36. In another embodiment, the plurality of vibration dampeners may be disposed about either the adjustable upper body 21 section or the adjustable lower body section 22 to provide vibration dampening of a certain vibration frequency range to just a portion of the patient. In yet another embodiment, one of the plurality of vibration dampeners may comprise the bushing 61 connected to the moveable strut 60 between the chassis assembly 30 and the mattress frame 25. As best illustrated in FIG. 7, the moveable strut 60 may each generally comprise a lift bar 62 connected to a bushing 61. The bushing 61 may be connected to one of the plurality of crossbars 36 of the chassis assembly 30 while the lift bar 62 may connect to the bed assembly 20. The lift bar 62 may be extendable such that as it extends in length, it raises a portion of the bed assembly 20 (as illustrated in FIG. 2). The bushing 61 may thereby comprise a vibration dampening material to reduce vibrations traveling through the crossbar 36 or lift bar 62. In one embodiment, the bushing 61 may comprise one or more o-rings disposed internal to the bushing 61 such that a rubber o-ring is disposed between the crossbar 36 and the bushing 61 and/or between the lift bar 62 and the bushing 61. In another embodiment, the interior of the bushing 61 and/or the exterior of the crossbar 36 or lift bar 62 may comprise a rubber surface wherein vibrations traveling there between are potentially dampened by the rubber surface.

Referring now to FIGS. 1-3, in yet another embodiment, the feet 39 may act as vibration dampeners on the life support litter 10. As discussed above, the feet 39 may comprise any structural support connected to the chassis assembly that maintains the life support litter in an elevated position off the ground and may allow for securement between the chassis assembly 30 and a transportation mechanism. To dampen vibrations traveling from the transport vehicle through the feet 39 and to the life support litter 10, one or more of the feet 39 may comprise a vibration dampening material or configuration. For example, in one embodiment, or more of the feet 39 may comprise a rubber material operable to at least partially dampen vibrations of a certain frequency range. For example, where the feet comprise a ring configuration, the center of the ring may comprise a rubber material operable to dampen vibrations passing through the feet 39. Alternatively or additionally, the feet may comprise a rubber surface or coating that engages the ground and is operable to dampen vibrations there between. In another embodiment, one or more of the feet 39 may comprise a relatively soft or bendable material (e.g., a relatively soft plastic) that can bend or shift to absorb external forces. In yet another embodiment, one or more of the feet 39 may comprise a spring configuration to reduce vertical movement of the life support litter 10 in the transport vehicle (such as when traveling over rough terrain).

Referring to FIGS. 1-4, in another embodiment, one of the plurality of vibration dampeners may comprise the mattress 26. For example, the mattress 26 may comprise any vibration dampening material such as rubber, foam, cloth, gel, or any other material operable to reduce vibrations. In one embodiment, as discussed above, the mattress may comprise one or more air bladders to reduce the amount of vibrations that are felt by a patient on the mattress 26. In another embodiment, the mattress 26 may comprise vibration dampening material on its bottom surface such that the mattress 26 and the mattress frame 25 are separated by rubber, foam, cloth, gel or the like. In such embodiments, the entire mattress 26 may comprise a vibration dampener, or select sections of the mattress 26 may comprise vibration dampeners.

As discussed above, each of the plurality of vibration dampeners may be targeted to reduce vibrations of specific frequency ranges. For example, where a first vibration dampener is the plurality of feet 39, the plurality of feet 39 may be configured to dampen vibrations in a first frequency range of from about 30 Hz to about 70 Hz as may be created by traveling in a helicopter. A second vibration dampener may be the one or more vertical chassis supports 40 and/or or the bushing 61 of the moveable strut 60. The second vibration dampener may be configured to dampen vibrations in a second frequency range of from about 450 Hz to about 550 Hz as may be created by traveling in an ambulance. Finally, a third vibration dampener may be the mattress 26 which is configured to dampen vibrations in a third frequency range of from about 1750 hz to about 1850 hz as may be experienced when transported on a collapsible litter transport assembly 80. The plurality of vibration dampeners may thereby cooperate to dampen the various vibrations a patient may feel throughout their entire transport cycle between the point of injury and a medical facility.

While reference has been made to specific components of the life support litter 10 as potential vibration dampeners, it should be appreciated that these possibilities are not exhaustive and one or more other components of the life support litter 10 may alternatively or additionally comprise vibration dampeners for dampening vibrations in a similar or different frequency range. For example, additional vibration dampeners may be disposed at any connection between two or more individual pieces or at any other location throughout the life support litter 10.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

The invention claimed is:

1. A life support litter comprising:

a bed assembly comprising a mattress connected to a mattress frame;

a chassis assembly connected to and supporting the mattress frame, the chassis assembly operable to secure the life support litter to a transport vehicle;

a plurality of vibration dampeners disposed about the life support litter and operable to reduce vibrations of a plurality of frequencies; and wherein the plurality of vibration dampeners comprises a first vibration dampener operable to reduce vibrations of a first frequency range from a first vibration source and a second vibration dampener operable to reduce vibrations of a second frequency range from a second vibration source, wherein the first frequency range is different than the second frequency range; and wherein the first or second vibration dampener comprises a plurality of grip assemblies connected to the chassis assembly and operable to collapse in towards the chassis assembly from an extended position to a collapsed position;

wherein each of the plurality of grip assemblies comprise:

a connection-end attached to the chassis assembly;

a plug insertable into and extending out from the connection-end;

a core configured to slide over and extend away from the plug;

an insulator operable to slide over the core, wherein the insulator comprises a vibration dampening material; and a grip connected to the core and the insulator, wherein the configuration of the grip assembly is operable to reduce vibrations.

2. The life support litter of claim 1 wherein the second vibration dampener comprises a mattress frame connection between the chassis assembly and the mattress frame, the mattress frame connection comprising a connection between an outer tube of the mattress frame and the chassis assembly.

3. The life support litter of claim 1 wherein the plurality of vibration dampeners further comprises a third vibration dampener operable to reduce vibrations of a third frequency range from a third vibration source.

4. The life support litter of claim 3 wherein the third vibration dampener comprises the mattress.

5. The life support litter of claim 1 wherein the first frequency range is between about 1750 Hz to about 1850 Hz, and the second frequency range is between about 450 Hz to about 550 Hz.

6. The life support litter of claim 3 wherein the third frequency range comprises from about 30 Hz to about 70 Hz.

7. The life support litter of claim 1 wherein the chassis assembly comprises a first upper horizontal tube connected to a first lower horizontal tube by a first plurality of vertical chassis supports and a second upper horizontal tube connected to a second lower horizontal tube by a second plurality of vertical chassis supports, wherein the first upper and lower horizontal tubes are connected to the second upper and lower horizontal tubes by a plurality of crossbars.

8. The life support litter of claim 7 wherein the first vibration dampener comprises the first plurality of vertical chassis supports and the second plurality of vertical chassis supports.

9. The life support litter of claim 1 wherein the bed assembly comprises an adjustable upper body section and an adjustable lower body section, wherein the first vibration dampener is disposed about either the adjustable upper body section or the adjustable lower body section.

10. A life support litter comprising:

a bed assembly comprising a mattress connected to a mattress frame;

a chassis assembly connected to and supporting the mattress frame, the chassis assembly comprising a first upper horizontal tube connected to a first lower horizontal tube by a first plurality of vertical chassis supports and a second upper horizontal tube connected to a second lower horizontal tube by a second plurality of vertical chassis supports, wherein the first upper and lower horizontal tubes are connected to the second upper and lower horizontal tubes by a plurality of crossbars;

a plurality of grip assemblies connected to the chassis assembly and operable to collapse in towards the chassis assembly from an extended position to a collapsed position; and a plurality of vibration dampeners disposed at a plurality of mattress frame connections between the chassis assembly and the mattress frame, wherein the plurality of vibration dampeners are operable to reduce vibrations of a plurality of frequencies;

wherein each of the plurality of grip assemblies comprise:

a connection-end attached to the chassis assembly;

a plug insertable into and extending out from the connection-end;

a core configured to slide over and extend away from the plug;

an insulator operable to slide over the core, wherein the insulator comprises a vibration dampening material; and a grip connected to the core and the insulator wherein the configuration of the grip assembly is operable to reduce vibrations.

11. The life support litter of claim 10 further comprising a first standardized mounting track disposed between the first upper horizontal tube and the first lower horizontal tube and a second standardized mounting track is disposed between the second upper horizontal tube and the second lower horizontal tube, the first and second standardized mounting tracks being operable to engage standardized mounting pins which are complementary to the standardized mounting track and used to mount medical equipment.

12. The life support litter of claim 10 wherein the bed assembly comprises an adjustable upper body section and an adjustable lower body section, and a moveable strut connecting the adjustable upper body section of the bed assembly to one of the plurality of crossbars of the chassis assembly, the moveable strut operable to raise and lower the adjustable upper body section.

13. The life support litter of claim 12 wherein the plurality of vibration dampeners are disposed where the moveable strut connects to the adjustable upper body section and where the moveable strut connects to the one of the plurality of crossbars.

14. The life support litter of claim 10 wherein the bed assembly comprises a plurality of safety restraints selected from the group consisting of an upper torso harness, a mid-section belt, a leg belt, or combinations thereof.

15. The life support litter of claim 10 wherein when the grip assembly is in the collapsed position, vibrations that would have passed through the grip when in the extended position may no longer pass through to the bed assembly.

16. The life support litter of claim 10 wherein a plurality of feet are connected to the chassis assembly and are operable to support the life support litter when on a floor, wherein the plurality of feet comprise vibration dampeners.

17. The life support litter of claim 10 wherein the chassis assembly is operable to secure to a collapsible litter transport assembly.

* * * * *